US008454113B2

(12) United States Patent
Paeng et al.

(10) Patent No.: US 8,454,113 B2
(45) Date of Patent: Jun. 4, 2013

(54) INK DISCHARGE DEVICE OF INKJET HEAD AND CONTROL METHOD THEREOF

(75) Inventors: Dong Woo Paeng, Anyang-si (KR); Kang Woong Ko, Seoul (KR); Jong Han Oh, Suwon-si (KR); Hyun Cheol Oh, Pyeongta-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 281 days.

(21) Appl. No.: 12/923,921

(22) Filed: Oct. 14, 2010

(65) Prior Publication Data

US 2011/0122187 A1 May 26, 2011

(30) Foreign Application Priority Data

Nov. 24, 2009 (KR) ..... 10-2009-0114149

(51) Int. Cl.
*B41J 2/205* (2006.01)
*B41J 29/38* (2006.01)

(52) U.S. Cl.
USPC ..... 347/15; 347/9

(58) Field of Classification Search
USPC ..... 347/14–15, 9–11, 20, 43–44, 47
See application file for complete search history.

(56) References Cited

U.S. PATENT DOCUMENTS

2004/0004643 A1* 1/2004 Satomura ..... 347/9
2004/0051770 A1* 3/2004 Clippingdale et al. ..... 347/112

* cited by examiner

*Primary Examiner* — Jason Uhlenhake
(74) *Attorney, Agent, or Firm* — Harness, Dickey & Pierce, P.L.C.

(57) ABSTRACT

Example embodiments are directed to an ink discharge device that discharges uniform amounts of ink droplets from an inkjet head, and a control method thereof. Voltages applied to plural nozzles of the ink-head are changed based on different characteristics of the respective nozzles to discharge uniform amounts of ink droplets from the nozzles. Voltage increments are calculated using a fixed target color value so as to set color value dispersion and voltage increments are calculated using different target color values according to the nozzles so as to satisfy color value differences between the neighboring pixels and thus time required for a DPN process is shortened, and excessive changes of the applied voltages are prevented and thus a preparatory period required to mass-produce an LCD panel is shortened and yield of the LCD panel is increased.

18 Claims, 5 Drawing Sheets

INK DISCHARGE DEVICE OF INKJET HEAD AND CONTROL METHOD THEREOF

CROSS-REFERENCE TO RELATED APPLICATION

This application claims priority under 35 U.S.C. §119 to Korean Patent Application No. 2009-0114149, filed on Nov. 24, 2009 in the Korean Intellectual Property Office, the entire disclosure of which is incorporated herein by reference.

BACKGROUND

1. Field

Example embodiments relate to an ink discharge device that discharges uniform amounts of ink droplets from an inkjet head, and a control method thereof.

2. Description of the Related Art

An inkjet printing apparatus is an apparatus which prints an image in a designated color by discharging fine droplets of an ink for printing at a desired position of a printing medium. The inkjet printing apparatus includes an inkjet head having a plurality of nozzles to discharge the ink droplets.

In order to manufacture an LCD panel of a superior quality in a printing process using the inkjet head, respective pixels of the LCD panel must have a uniform color value. Such a uniform color value may be obtained by adjusting an amount of ink droplets filling the respective pixels. That is, it is of relative importance in manufacture of the LCD panel having an excellent quality to uniformly adjust the amount of ink droplets discharged from the inkjet head.

Generally, when color values of the respective pixels printed by applying an equal voltage to the respective nozzles of the inkjet head are measured, the color values of the respective pixels are different such that an inspector can make out the difference with the naked eye. That is, although the equal voltage is applied to the nozzles of the inkjet head, the nozzles may not discharge an equal amount of ink droplets due to characteristics of the respective nozzles. Therefore, voltage applied to each of the nozzles is varied so as to discharge a uniform amount of droplets from the nozzles. This process is referred to as a Driver per Nozzle (DPN) process. During a conventional DPN process, feedback of substantially printed color values is required to control applied voltage. It takes a relatively long time to receive such a feedback. Further, due to characteristics of the respective nozzles, the equal color value is not always obtained under equal voltage and there are noise components. In order to calculate voltages applied to the respective nozzles according to the noise components, multiple-order printing and feedback of printed color values is required. Thereby, it takes a relatively long time to discharge uniform amounts of ink droplets discharged from a plurality of nozzles having different characteristics.

SUMMARY

According to example embodiments, an ink discharge device, of an inkjet head includes a plurality of nozzles configured to discharge ink; a measurement unit configured to measure color values of the plurality of nozzles based on voltages applied to the plurality of the nozzles; and a control unit configured to compare the color values of the plurality of nozzles with target values set according to different characteristics of the plurality of nozzles, and configured to change the voltages applied to the plurality of nozzles such that the color values of the plurality of nozzles are uniform.

According to example embodiments, each of the target values is an average of the sum total of the color values of a desired number of the nozzles neighboring including a desired nozzle of the plurality of nozzles.

According to example embodiments, different target values are set for nozzles of the plurality of nozzles.

According to example embodiments, the control unit calculates voltage increments individually applied to the plurality of nozzles based on the target values such that overall color value dispersion of the plurality of nozzles does not exceed a set reference value.

According to example embodiments, the ink discharge device, further includes a plurality of actuators respectively installed at the plurality of nozzles, the plurality of actuators configured to adjust amounts of ink discharged from the plurality of nozzles, wherein the measurement unit measures color values of the plurality of nozzles when a same voltage is applied to the plurality of the actuators.

According to example embodiments, the control unit individually controls the voltage applied to the plurality of actuators based on the color values of the plurality of the nozzles.

According to example embodiments, the control unit calculates voltage increments individually applied to the plurality of nozzles using a fixed target value such that overall color value dispersion of the plurality of nozzles does not exceed a set reference value.

According to example embodiments, the control, unit calculates voltage increments individually applied to the plurality of nozzles using a dynamic target value such that differences of the color values between the neighboring pixels do not exceed a set maximum value.

According to example embodiments, the dynamic target value is an operationally variable value set as a reference of the applied voltages to minimize changes of voltage individually applied to the plurality of nozzles.

According to example embodiments, an ink discharge device of an inkjet head includes a plurality of nozzles configured to discharge ink; a measurement unit configured to measure color values of the plurality of nozzles based on voltages applied to the plurality of the nozzles; and a control unit configured to compare the color values of the plurality of nozzles with target values set according to different characteristics of the plurality of nozzles, and configured to change the voltages applied to the plurality of nozzles such that an amount of ink discharged from the plurality of nozzles is uniform.

According to example embodiments, each of the target values is an average of the sum total of the color values of a desired number of the nozzles neighboring a desired nozzle of the plurality of nozzles.

According to example embodiments, wherein different target values are set for nozzles of the plurality of nozzles.

According to example embodiments, the ink discharge device, further includes a plurality of actuators respectively installed at the plurality of nozzles to adjust the amounts of ink discharged from the plurality of nozzles, wherein the control unit calculates voltage increments individually applied to the plurality of nozzles using a fixed target value such that overall color value dispersion of the plurality of nozzles does not exceed a set reference value.

According to example embodiments, the ink discharge device, further includes a plurality of actuators respectively installed at the plurality of nozzles to adjust the amounts of ink discharged from the plurality of nozzles, wherein the control unit calculates voltage increments individually applied to the plurality of nozzles using a dynamic target value such that differences of the color values between the neighboring pixels do not exceed a set maximum value.

According to example embodiments, the dynamic target value is an operationally variable value set as reference of the applied voltages to minimize changes of voltage individually applied to the plurality of actuators of the plurality of nozzles.

According to example embodiments, a method of controlling discharge of ink through a plurality of nozzles of an inkjet head includes measuring color values discharged from the plurality of nozzles on respective pixels, the measurement based on voltages applied to the plurality of the nozzles; comparing the color values of the plurality of nozzles with target values, and changing the voltages applied to the plurality of nozzles such that overall color value dispersion of the plurality of nozzles does not exceed a set reference value; and comparing the color values of the plurality of nozzles with the target values, and changing the voltages applied to the plurality of nozzles such that differences of the color values between the neighboring pixels do not exceed a set maximum value.

According to example embodiments, at least one of the target values is an average of the sum total of the color values of a desired number of the nozzles neighboring a desired nozzle of the plurality of nozzles.

According to example embodiments, different target values are set for different nozzles of the plurality of nozzles.

BRIEF DESCRIPTION OF THE DRAWINGS

The above and other features and advantages will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
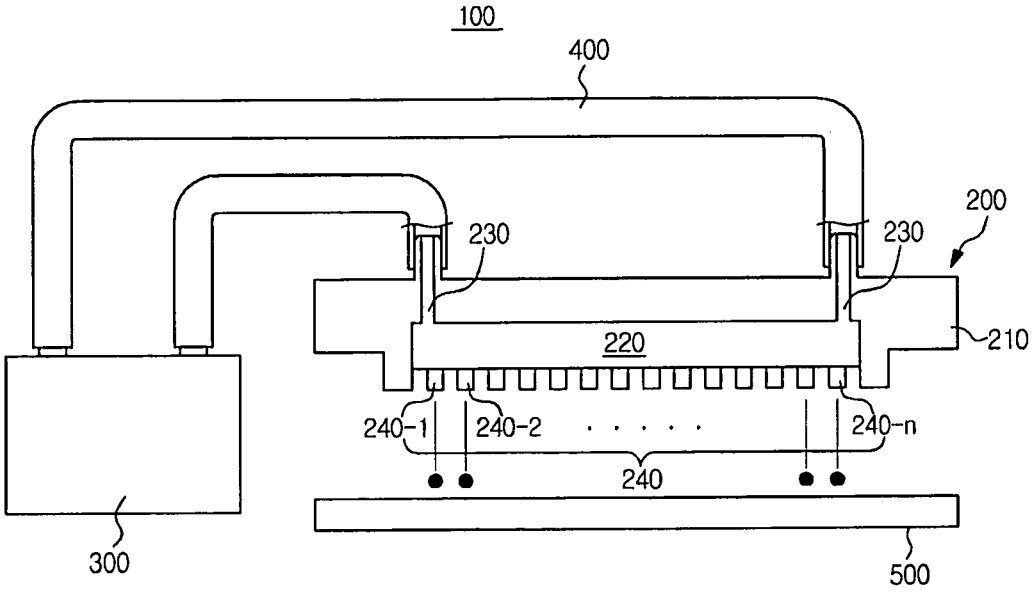
FIG. 1 illustrates an inkjet printing apparatus according to example embodiments.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 1 is a schematic view of an inkjet printing apparatus according to example embodiments.

In FIG. 1, an inkjet printing apparatus 100 includes an inkjet head 200, an inkjet reservoir 300 to store an ink, and ink supply pipes 400 to supply the ink.

The inkjet head 200 includes a main body 210 forming the external appearance of the inkjet head 200, a common channel 220 formed within the main body 210 to contain the ink, inlets 230 to introduce the ink into the common channel 220, and a plurality of nozzles 240; 240-1, 240-2, . . . , and **240-*n* to discharge the ink contained in the common channel 220 to the outside of the main body 210**.

The inlets 230 of the inkjet head 200 are connected to the ink supply pipes 400, and supply the ink stored in the ink reservoir 300 to the common channel 220.

The plurality of the nozzles 240; 240-1, 240-2, . . . , and **240-*n* of the inkjet head 200 are connected to the ink channel 220, and receive the ink contained in the common channel 220 and spray the ink in a form of droplets on an LCD panel 500**.

The ink supply pipes 400 are connected to the ink reservoir 300, and supply the ink stored in the ink reservoir 300 to the common channel 220 through the inlets 230.

Figure 2:
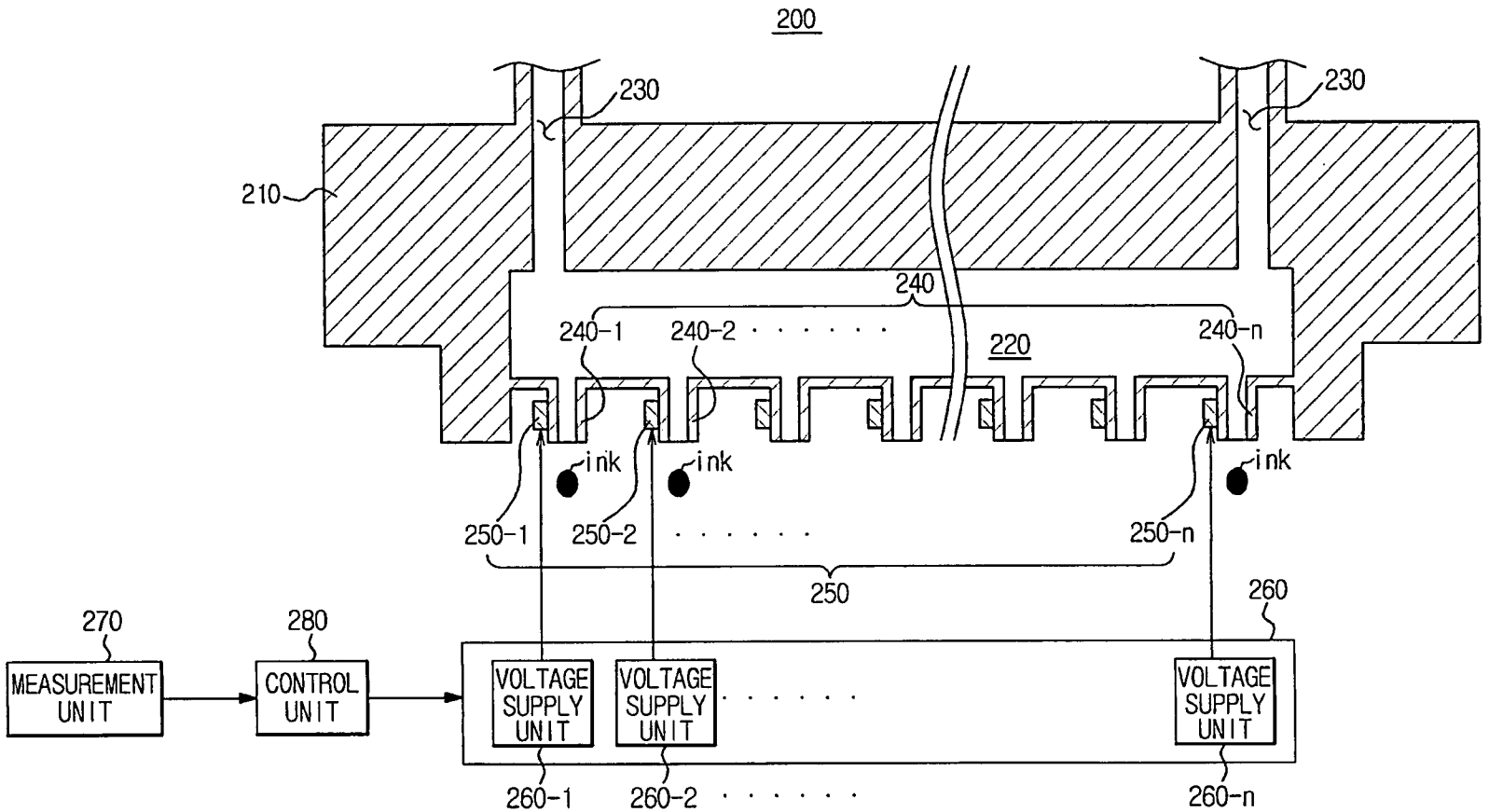
FIG. 2 is a control diagram of the inkjet head according to example embodiments.

FIG. 2 is a control diagram of the inkjet head according to example embodiments.

As shown in FIG. 2, the inkjet head 200 includes a plurality of actuators 250; 250-1, 250-2, . . . , and **250-*n* to adjust discharge amounts of the ink droplets, a plurality of voltage supply units 260; 260-1, 260-2, . . . , and 260-*n*, a measurement unit 270, and a control unit 280**.

The plural actuators 250; 250-1, 250-2, . . . , and **250-*n* are respectively installed on the plural nozzles 240; 240-1, 240-2, . . . , and 240-*n*, and generate driving force causing the corresponding nozzles 240; 240-1, 240-2, . . . , and 240-*n* to respectively spray the ink. In more detail, the plural actuators 250; 250-1, 250-2, and 250-*n* cause the ink, contained in the plural nozzles 240; 240-1, 240-2, . . . , and 240-*n*, to be discharged in a droplet state through spray mechanisms respectively contracting and extending the plural nozzles 240; 240-1, 240-2, . . . , and 240-*n*. That is, the inkjet head 200 discharges the ink droplets onto the LCD panel 500 through the plural nozzles 240; 240-1, 240-2, . . . , and 240-*n***.

The spray mechanisms respectively contracting and extending the plural nozzles 240; 240-1, 240-2, . . . , and **240-*n* to spray the ink droplets are operated using a piezoelectric method and/or a thermal method in which pressure or heat is applied to the plural nozzles 240; 240-1, 240-2, . . . , and 240-*n*. The plural nozzles 240; 240-1, 240-2, . . . , and 240-*n*** are made of a material which can be contracted or extended by pressure and/or heat.

The plural voltage supply units 260; 260-1, 260-2, . . . , and **260-*n* individually supply voltages respectively applied to the plural actuators 250; 250-1, 250-2, . . . , and 250-*n* under the control of the control unit 280. The plural voltage supply units 260; 260-1, 260-2, . . . , and 260-*n* supply incremental values of voltages to the plural nozzles 240, 240-1, 240-2, . . . , and 240-*n*, thereby minimizing variations of the voltages applied to the corresponding nozzles 240; 240-1, 240-2, . . . , and 240-*n***.

The plural actuators 250; 250-1, 250-2, . . . , and **250-*n* of the plural nozzles 240; 240-1, 240-2, . . . , and 240-*n* are electrically connected to the plural voltage supply units 260; 260-1, 260-2, . . . , and 260-*n*, respectively, and generate different spray driving forces according to the individual voltages supplied from the plural voltage supply units 260; 260-1, 260-2, . . . , and 260-*n***.

The measurement unit 270 measures color values in respective pixels of the LCD panels 500, when the ink droplets discharged from the plural nozzles 240; 240-1, 240-2, . . . , and **240-*n* are sprayed on the respective pixels of the LCD panels 500 based on the voltages applied to the plural nozzles 240; 240-1, 240-2, . . . , and 240-*n*. The measurement unit 270 may obtain images of the ink droplets discharged from the plural nozzles 240; 240-1, 240-2, . . . , and 240-*n* using an illumination device and a scan camera (not shown). When the ink droplets discharged from the plural nozzles 240; 240-1, 240-2, . . . , and 240-*n* are sprayed on the LCD panel 500**, the illumination device irradiates light on the ink droplets, and the scan camera captures the images of the ink droplets, for example, values of colors sprayed onto the respective pixels, using the light emitted from the illumination device.

In order to obtain the LCD panel 500 having an excellent quality using an inkjet printing method, it is required to minimize a spot from being visible to the naked eye. As described above, the spot is generated by non-uniform amounts of the ink droplets filling the respective pixels of the LCD panel 500. If the following two conditions are satisfied, spots is visible with the naked eye are minimized.

$$\mathrm{Max}[T(1),(T2),\ldots,T(n)]-\mathrm{Min}[T(1),(T2),\ldots,T(n)]<A$$

$$\mathrm{Max}[|T(1)-T(2)|,|T(2)-T(1)|,\ldots,|T(n)-T(n-1)|]<B$$

Here, T(1), (T2), . . . , T(n) is a set of color values of the respective pixels, |T(1)−T(2)|, |T(2)−T(1)|, . . . , |T(n)−T(n−1)| is a set of absolute values of color value differences (hereinafter, referred to as neighboring color value differences) between neighboring pixels (next pixels), A is a reference value of overall color value dispersion of the plural nozzles 240; 240-1, 240-2, . . . , and **240-*n***, and B is the maximum value of the neighboring color value differences.

In order to satisfy the above two conditions, different voltages V(1), V(2), . . . , V(k) are applied to k nozzles N(1), N(2), . . . , N(k). A DPN process according to example embodiments may meet the above two conditions in a relatively short time.

For this reason, the control unit 280 calculates new voltages to be applied based on the color values of the respective pixels measured by the measurement unit 270. A method according to example embodiments of calculating the new voltages is disclosed below.

The control unit 280 receives color values, obtained by spraying ink droplets on the respective pixels based on voltages respectively applied to the nozzles 240; 240-1, 240-2, . . . , and **240-*n* of the inkjet head 200, from the measurement unit 270**, compares the color values with set target color values (hereinafter, referred to as target values), and calculates increments of the applied voltages to satisfy overall color value dispersion and increments of the applied voltages to satisfy neighboring color value differences according to results of the comparison.

Here, the control unit 280 uses a fixed target value and a dynamic target value as the target values in calculating voltages applied to the respective nozzles 240; 240-1, 240-2, . . . , and **240-*n*** in order to discharge uniform amounts of the ink droplets.

That is, the control unit 280 divides the overall DPN process into a process of satisfying overall color value dispersion and a process of satisfying neighboring color value differences. The fixed target value is used during the process of satisfying overall color value dispersion and the dynamic target value is used during the process of satisfying neighboring color value differences, and thus different target values to discharge uniform amounts of the ink droplets are set according to the different characteristics of nozzles 240; 240-1, 240-2, . . . , and **240-*n*. Therefore, the voltage supply units 260; 260-1, 260-2, . . . , and 260-*n* individually control voltages respectively applied to the actuators 250; 250-1, 250-2, . . . , and 250-*n* of the plural nozzles 240; 240-1, 240-2, . . . , and 240-*n* under the control of the control unit 280**.

The dynamic target value is set from the below Equation 1 using a moving average method, for example.

$$C_t(n)=\frac{1}{61}\sum_{i=n-30}^{61}C(i) \qquad \text{[Equation 1]}$$

In the above Equation 1, $C_t(n)$ is a dynamic target value at an $n^{th}$ nozzle.

As an example, a dynamic target value $C_t(31)$ to calculate voltage applied to a $31^{st}$ nozzle is set to be an average of the sum total of color values of 30 nozzles ($1^{st}$~$30^{th}$ nozzles) preceding the $31^{st}$ nozzle (corresponding nozzle) and 30 nozzles ($32^{th}$~$61^{st}$ nozzles) succeeding the $31^{st}$ nozzle, i.e., an average of the sum total of color values of $1^{st}$~$61^{st}$ nozzles.

As another example, a dynamic target value $C_t(61)$ to calculate voltage applied to a $61^{st}$ nozzle is set to be an average of the sum total of color values of 30 nozzles ($31^{st}$~$60^{th}$ nozzles) preceding to the $61^{st}$ nozzle (corresponding nozzle) and 30 nozzles ($62^{th}$~$91^{st}$ nozzles) succeeding the $61^{st}$ nozzle, i.e., an average of the sum total of color values of $31^{st}$~$91^{st}$ nozzles.

Although example embodiments illustrate that the dynamic target value is set to be an average of the sum total of color values of 30 nozzles preceding to a corresponding nozzle 240; 240-1, 240-2, . . . , or 240-*n* and 30 nozzles succeeding the corresponding nozzle 240; 240-1, 240-2, . . . , or 240-*n*, the number of the nozzles preceding to the corresponding nozzle 240; 240-1, 240-2, . . . , or 240-*n* and the number of the nozzles succeeding the corresponding nozzle 240; 240-1, 240-2, . . . , or 240-*n* may be modified.

Therefore, the control unit 280 individually supplies voltages applied to the actuators 250; 250-1, 250-2, . . . , and 250-*n* of the plural nozzles 240; 240-1, 240-2, . . . , and 240-*n*, thereby causing the respective pixels of the LCD panel 500 to have a uniform color value.

Hereinafter, the operating process and effects of the above-described ink discharge device of the inkjet head and the control method thereof will be described.

The plural nozzles 240; 240-1, 240-2, . . . , and 240-*n* of the inkjet head 200 discharge different amounts of ink droplets according to structural and electrical characteristics of the nozzles 240; 240-1, 240-2, . . . , and 240-*n*, although an equal voltage is applied to the actuators 250; 250-1, 250-2, . . . , and 250-*n*.

Figure 3:
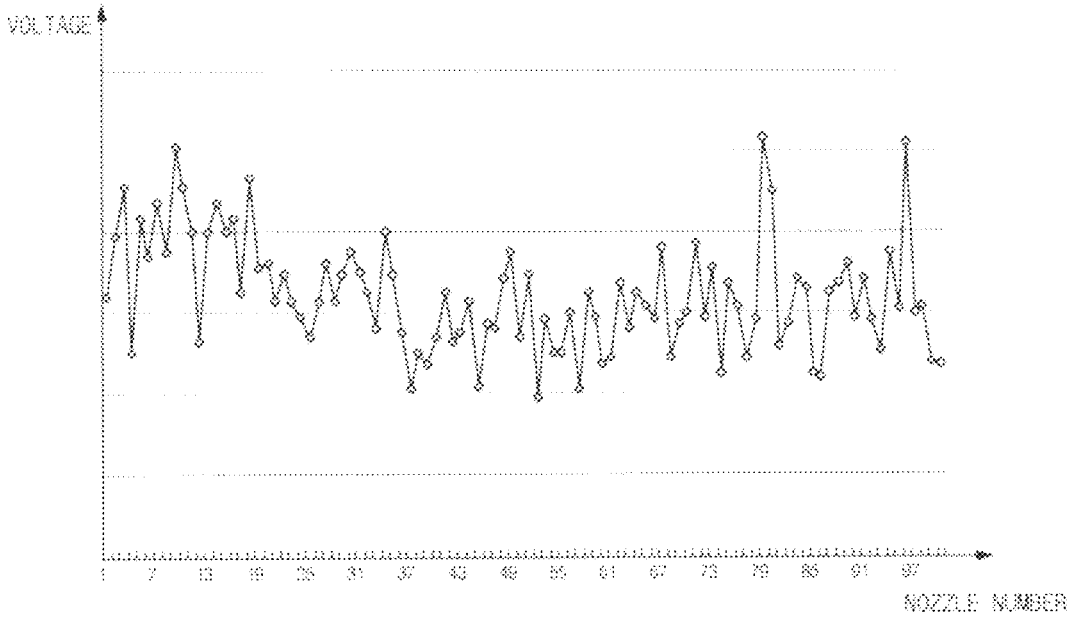
FIG. 3 is a graph illustrating voltages applied to respective nozzles in order to obtain an equal ink discharge amount from the inkjet head according to example embodiments.

FIG. 3 is a graph illustrating voltages applied to the respective nozzles in order to obtain an equal ink discharge amount from the inkjet head according to example embodiments.

As shown in FIG. 3, in order to solve the above problem, for example, discharge of different amounts of the ink droplets from the nozzles 240; 240-1, 240-2, . . . , and 240-*n* although an equal voltage is applied to the respective nozzles 240; 240-1, 240-2, . . . , and 240-*n* of the inkjet head 200, different voltages are applied to the respective nozzles 240; 240-1, 240-2, . . . , and 240-*n*. For example, voltages applied to the nozzles 240; 240-1, 240-2, . . . , and 240-*n* which discharge larger amounts of the ink droplets than a target amount are lowered and voltages applied to the nozzles 240; 240-1, 240-2, . . . , and 240-*n* which discharge smaller amounts of the ink droplets than the target amount are raised, so that uniform amounts of ink is discharged from the respective nozzles 240; 240-1, 240-2, . . . , and 240-*n*.

Figure 4:
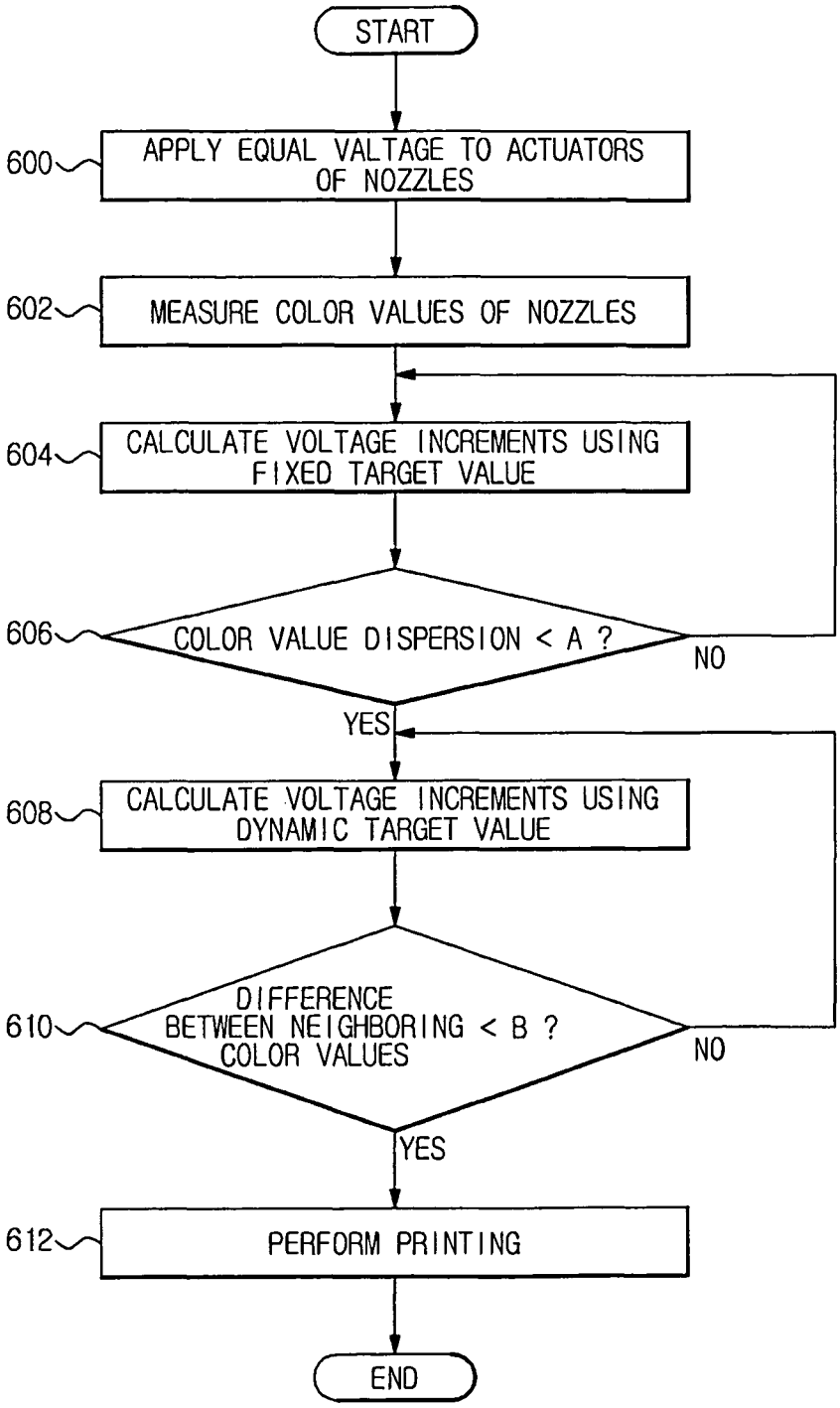
FIG. 4 is a flow chart illustrating a control method to obtain the equal ink discharge amount from the inkjet head according to example embodiments.

FIG. 4 is a flow chart illustrating a control method to obtain the equal ink discharge amount from the inkjet head according to example embodiments.

With reference to FIG. 4, the voltage supply units 260; 260-1, 260-2, . . . , and 260-*n* apply an equal voltage to the actuators 250; 250-1, 250-2 of the respective nozzles 240; 240-1, 240-2, . . . , and 240-*n* (about 96~256 nozzles) of the inkjet head 200 (operation 600). Then, the measurement unit 270 measures color values in the respective pixels of the LCD panel 500 according to amounts of ink droplets discharged from the respective nozzles 240; 240-1, 240-2, . . . , and 240-*n* based on the voltage respectively applied to the nozzles 240; 240-1, 240-2, . . . , and 240-*n* of the inkjet head 200, and transmits the measured color values to the control unit 280 (operation 602).

Thereafter, the control unit 280 calculates increments of voltage applied to the respective nozzles 240; 240-1, 240-2, . . . , and 240-*n* by comparing the color values measured by the measurement unit 270 with a fixed target value, and calculates variations of voltage to be applied to the respective nozzles 240; 240-1, 240-2, . . . , and 240-*n* according to the calculated increments of voltage, thereby controlling amounts of the ink droplets discharged from the respective nozzles 240; 240-1, 240-2, . . . , and 240-*n* (operation 604).

Thereafter, the control unit 280 judges whether or not an overall color value dispersion of the plural respective nozzles 240; 240-1, 240-2, . . . , and 240-*n*, obtained based on the measured color values, is smaller than a set value A (operation 606), and, if the overall color value dispersion is not smaller than the set value A, feedback to operation 604 is carried out and then the subsequent operations are repeated.

As a result of judgment of operation 606, if the overall color value dispersion is smaller than the set value A, the control unit 280 judges that amounts of the ink droplets discharged from the respective nozzles 240; 240-1, 240-2, . . . , and 240-*n* of the ink head 200 and uniformly fills the respective pixels of the LCD panel 500.

Thereafter, in order to satisfy differences between the neighboring color values, the control unit 290 calculates increments of voltage applied to the respective nozzles 240; 240-1, 240-2, . . . , and 240-*n* by comparing the color values measured by the measurement unit 270 with set dynamic target values, and calculates variations of voltage applied to the respective nozzles 240; 240-1, 240-2, . . . , and 240-*n* according to the calculated increments of voltage, thereby controlling amounts of the ink droplets discharged from the respective nozzles 240; 240-1, 240-2, . . . , and 240-*n* (operation 608).

Thereafter, the control unit 280 judges whether or not differences between the neighboring color values, obtained based on the measured color values, are smaller than a set value B (operation 610), and, if the differences between the neighboring color values are not smaller than the set value B, feedback to operation 608 is carried out and then the subsequent operations are repeated.

As a result of judgment of operation 610, if the differences between the neighboring color values are smaller than the set value B, the control unit 280 judges that amounts of the ink droplets discharged from the respective nozzles 240; 240-1, 240-2, . . . , and 240-*n* of the ink head 200 and filling the respective pixels of the LCD panel 500 satisfies the difference requirement between the neighboring color values, and thus performs printing (operation 612).

Figure 5:
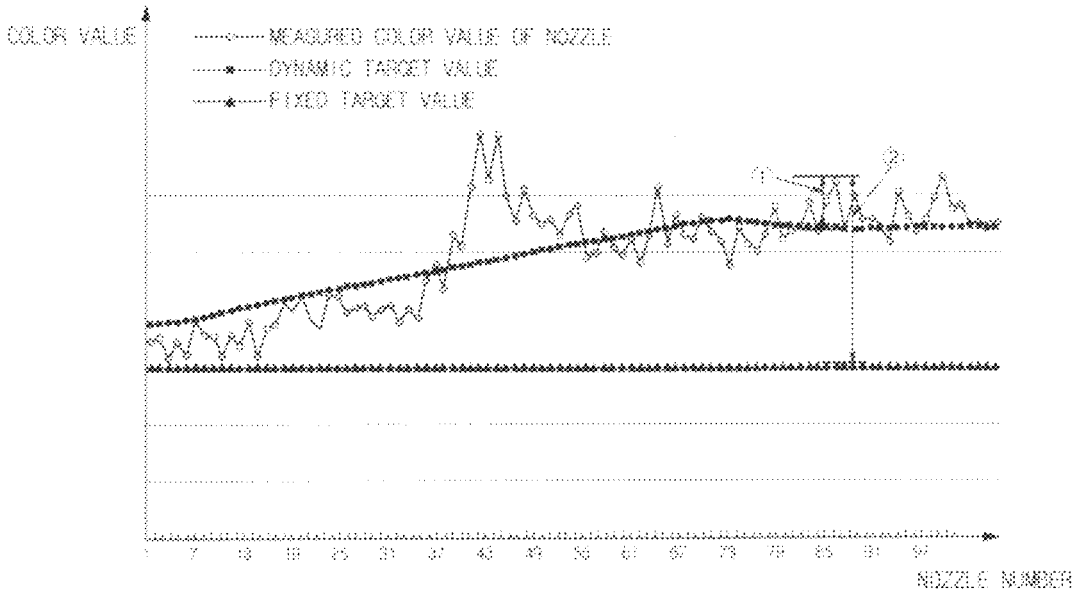
FIG. 5 is a graph illustrating variations of applied voltages in the inkjet head using the DPN process, according to example embodiments, as compared with a conventional inkjet head.

FIG. 5 is a graph illustrating variations of applied voltages in the inkjet head using the DPN process, according to example embodiments, as compared with a conventional inkjet head.

As shown in FIG. 5, when next-order voltages to be applied to the nozzles 240; 240-1, 240-2, . . . , and 240-*n* of the ink head 200 are determined based on the measured color values of the nozzles 240; 240-1, 240-2, . . . , and 240-*n*, increments of voltage $\hat{1}$ calculated with dynamic target values using the moving average method according to example embodiments are considerably smaller than voltage increments $\hat{2}$ calculated with the conventional fixed target value.

Since the inkjet head 200 uses the common channel, as shown in FIGS. 1 and 2, interference due to changes of the flow of a fluid may occur. In this case, when the applied voltage is raised or lowered based on a uniformly fixed target value, the fluid flow is rapidly changed and thus serves as a noise component varying amount of the ink discharged from other nozzles 240; 240-1, 240-2, . . . , and 240-*n*. Therefore, increase in control order is indispensable so as to achieve convergence and the possibility of deviating the inkjet head 200 from a stable region is sufficient. Accordingly, when dynamic target values are set using the moving average method according to example embodiments, changes of voltage applied to the corresponding nozzles 240; 240-1, 240-2, . . . , and 240-*n* are minimized, thereby excluding interference and assuring the operation of the inkjet head within a stable region.

In an ink discharge device of an inkjet head and a control method thereof according to example embodiments, when voltages applied to plural nozzles of the ink-head are changed based on different characteristics of the respective nozzles so as to uniformly discharge amounts of ink droplets from the nozzles, increments of voltage are calculated using a fixed target color value so as to satisfy color value dispersion and voltage increments are calculated using moving average target color values so as to satisfy color value differences between the neighboring pixels and thus time required for a DPN process is shortened, and excessive changes of the applied voltages are prevented and thus a preparatory period required to mass-produce an LCD panel is shortened and yield of the LCD panel is increased.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. An ink discharge device of an inkjet head, the ink discharge device comprising:

a plurality of nozzles configured to discharge ink;

a measurement unit configured to measure color values of the plurality of nozzles based on voltages applied to the plurality of the nozzles; and a control unit configured to compare the color values of the plurality of nozzles with target values set according to different characteristics of the plurality of nozzles, and configured to change the voltages applied to the plurality of nozzles such that the color values of the plurality of nozzles are uniform, and configured to calculate increments of the applied voltages to satisfy overall color value dispersion and increments of the applied voltages to satisfy neighboring color value differences according to results of the comparison.

2. The ink discharge device according to claim 1, wherein each of the target values is an average of the sum total of the color values of a desired number of the nozzles neighboring a desired nozzle of the plurality of nozzles.

3. The ink discharge device according to claim 1, wherein different target values are set for nozzles of the plurality of nozzles.

4. The ink discharge device according to claim 1, wherein the control unit calculates voltage increments individually applied to the plurality of nozzles based on the target values such that overall color value dispersion of the plurality of nozzles does not exceed a set reference value.

5. The ink discharge device according to claim 1, further comprising:

a plurality of actuators respectively installed at the plurality of nozzles, the plurality of actuators configured to adjust amounts of ink discharged from the plurality of nozzles, wherein the measurement unit measures color values of the plurality of nozzles when a same voltage is applied to the plurality of the actuators.

6. The ink discharge device according to claim 5, wherein the control unit individually controls the voltage applied to the plurality of actuators based on the color values of the plurality of the nozzles.

7. The ink discharge device according to claim 6, wherein the control unit calculates voltage increments individually applied to the plurality of nozzles using a fixed target value such that overall color value dispersion of the plurality of nozzles does not exceed a set reference value.

8. The ink discharge device according to claim 6, wherein the control unit calculates voltage increments individually applied to the plurality of nozzles using a dynamic target value such that differences of the color values between the neighboring pixels do not exceed a set maximum value.

9. The ink discharge device according to claim 8, wherein the dynamic target value is an operationally variable value set as a reference of the applied voltages to minimize changes of voltage individually applied to the plurality of nozzles.

10. An ink discharge device of an inkjet head, the ink discharge device comprising:

a plurality of nozzles configured to discharge ink;

a measurement unit configured to measure color values of the plurality of nozzles based on voltages applied to the plurality of the nozzles; and a control unit configured to compare the color values of the plurality of nozzles with target values set according to different characteristics of the plurality of nozzles, and configured to change the voltages applied to the plurality of nozzles such that an amount of ink discharged from the plurality of nozzles is uniform, and configured to calculate increments of the applied voltages to satisfy overall color value dispersion and increments of the applied voltages to satisfy neighboring color value differences according to results of the comparison.

11. The ink discharge device according to claim 10, wherein each of the target values is an average of the sum total of the color values of a desired number of the nozzles neighboring a desired nozzle of the plurality of nozzles.

12. The ink discharge device according to claim 10, wherein different target values are set for nozzles of the plurality of nozzles.

13. The ink discharge device according to claim 10, further comprising:

a plurality of actuators respectively installed at the plurality of nozzles to adjust the amounts of ink discharged from the plurality of nozzles, wherein the control unit calculates voltage increments individually applied to the plurality of nozzles using a fixed target value such that overall color value dispersion of the plurality of nozzles does not exceed a set reference value.

14. The ink discharge device according to claim 10, further comprising:

a plurality of actuators respectively installed at the plurality of nozzles to adjust the amounts of ink discharged from the plurality of nozzles, wherein the control unit calculates voltage increments individually applied to the plurality of nozzles using a dynamic target value such that differences of the color values between the neighboring pixels do not exceed a set maximum value.

15. The ink discharge device according to claim 14, wherein the dynamic target value is an operationally variable value set as reference of the applied voltages to minimize changes of voltage individually applied to the plurality of actuators of the plurality of nozzles.

16. A method of controlling discharge of ink through a plurality of nozzles of an inkjet head, the method comprising:

measuring color values discharged from the plurality of nozzles on respective pixels, the measurement based on voltages applied to the plurality of the nozzles;

comparing the color values of the plurality of nozzles with target values, and changing the voltages applied to the plurality of nozzles such that overall color value dispersion of the plurality of nozzles does not exceed a set reference value;

comparing the color values of the plurality of nozzles with the target values, and changing the voltages applied to the plurality of nozzles such that differences of the color values between the neighboring pixels do not exceed a set maximum value; and calculating increments of the applied voltages to satisfy overall color value dispersion and increments of the applied voltages to satisfy neighboring color value differences according to results of the comparison.

17. The method according to claim 16, wherein at least one of the target values is an average of the sum total of the color values of a desired number of the nozzles neighboring a desired nozzle of the plurality of nozzles.

18. The method according to claim 16, wherein different target values are set for different nozzles of the plurality of nozzles.

* * * * *